US011318763B2

(12) United States Patent
Kishida

(10) Patent No.: US 11,318,763 B2
(45) Date of Patent: May 3, 2022

(54) INKJET PRINTER AND CONTROL METHOD FOR INKJET PRINTER

(71) Applicant: MIMAKI ENGINEERING CO., LTD., Nagano (JP)

(72) Inventor: Yutaro Kishida, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 17/151,678

(22) Filed: Jan. 19, 2021

(65) Prior Publication Data

US 2021/0221150 A1 Jul. 22, 2021

(30) Foreign Application Priority Data

Jan. 20, 2020 (JP) ..... JP2020-006475

(51) Int. Cl.
*B41J 11/00* (2006.01)

(52) U.S. Cl.
CPC .... *B41J 11/00214* (2021.01); *B41J 11/00212* (2021.01)

(58) Field of Classification Search
CPC ..... B41J 11/00214; B41J 11/00212
See application file for complete search history.

(56) References Cited

FOREIGN PATENT DOCUMENTS

JP WO2011/099557 * 6/2013
JP 2015214133 12/2015

* cited by examiner

*Primary Examiner* — Justin Seo
(74) *Attorney, Agent, or Firm* — JCIPRNET

(57) ABSTRACT

In an inkjet printer, an ultraviolet irradiator includes a first irradiation portion disposed at the same position as a color ink ejection portion in a front-back direction and a third irradiation portion disposed on the front side of a clear ink ejection portion in the front-back direction, where at the time of printing in a gloss tone printing mode, an average illuminance of a fifth irradiation portion that forms the front side portion of the first irradiation portion is lower than an average illuminance of a fourth irradiation portion that forms the back side portion of the first irradiation portion.

19 Claims, 8 Drawing Sheets

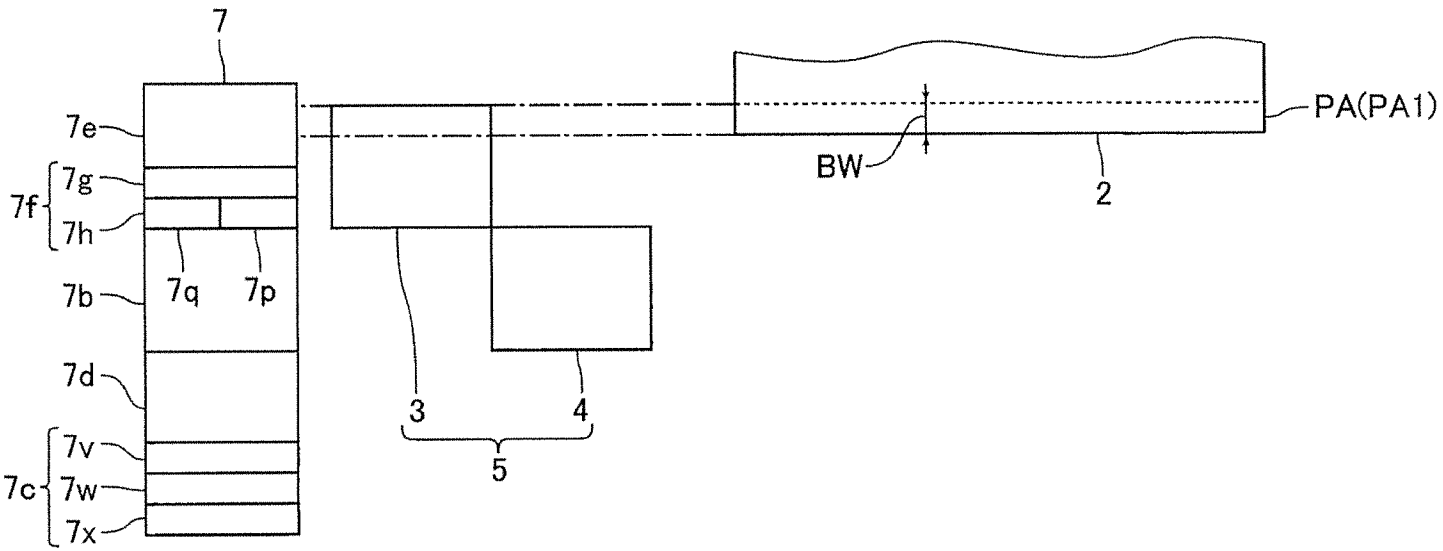
FIG. 4A
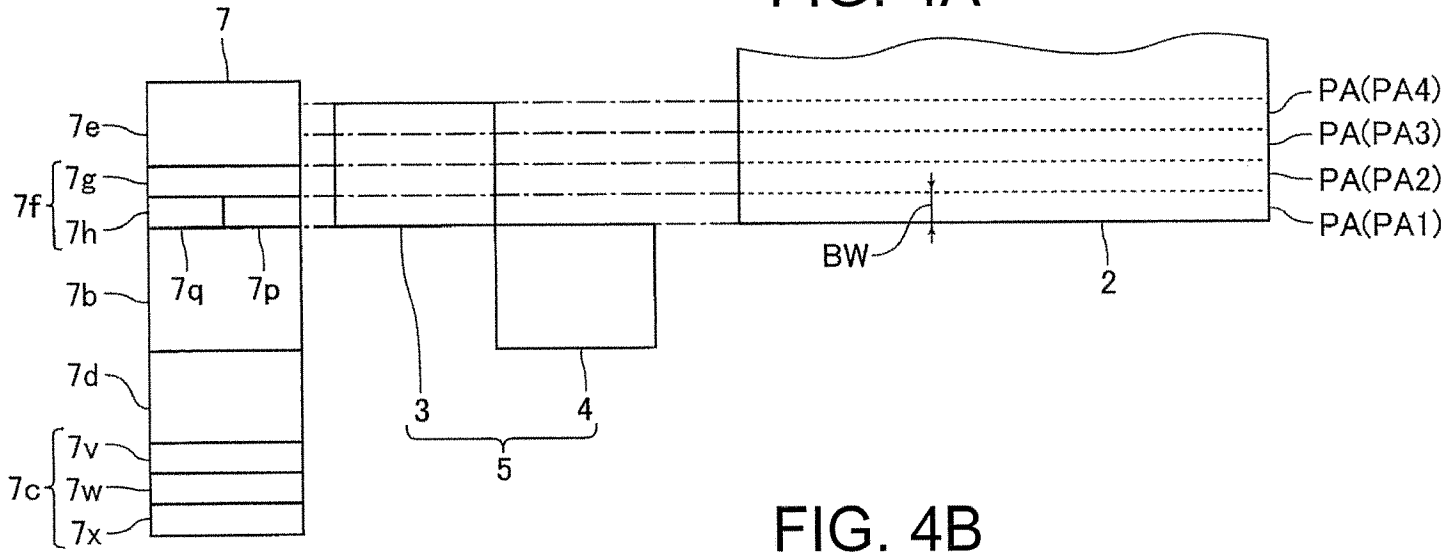
FIG. 4B
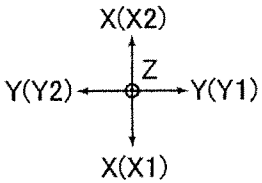

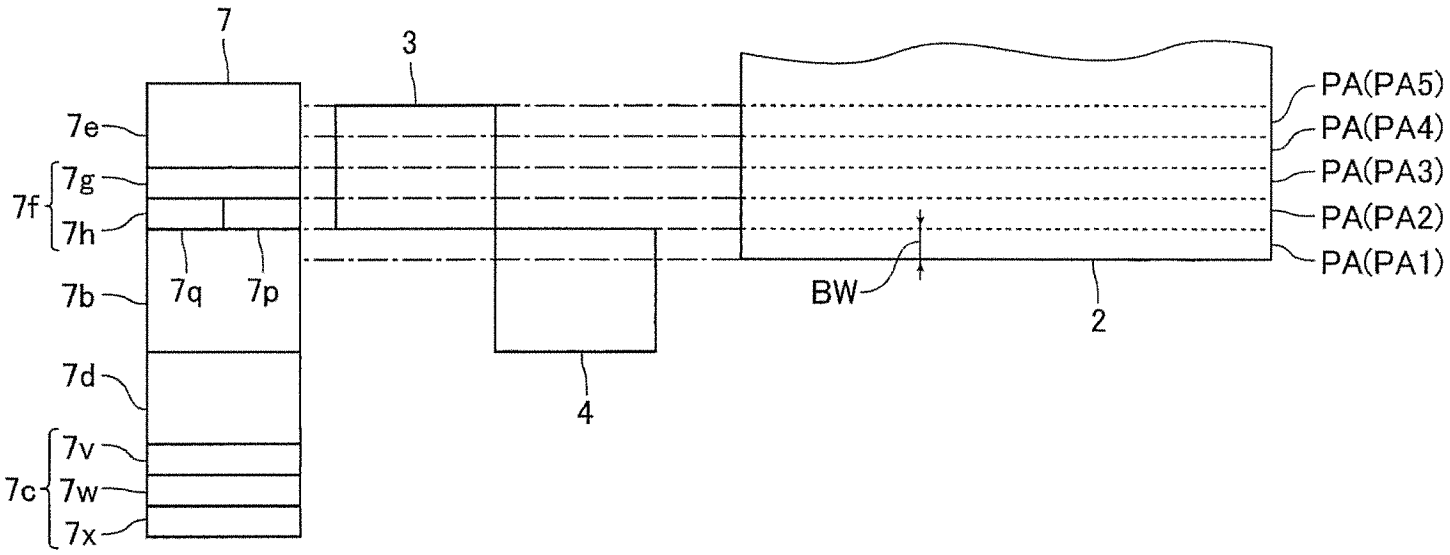
FIG. 5A
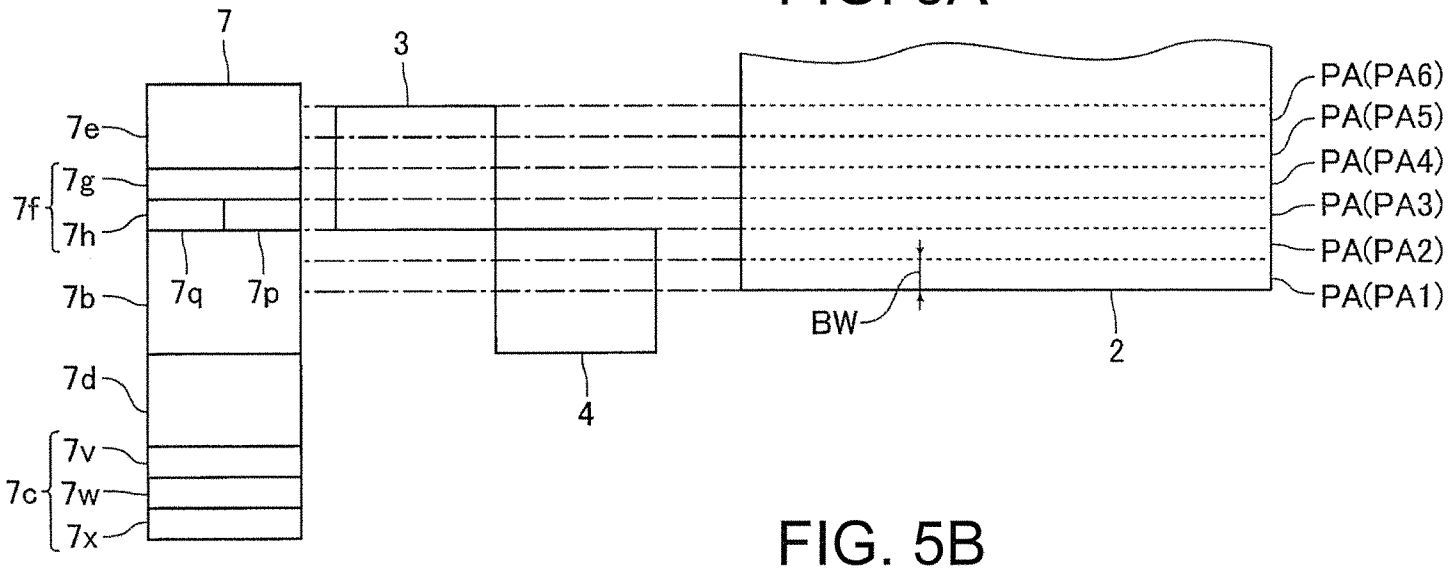
FIG. 5B
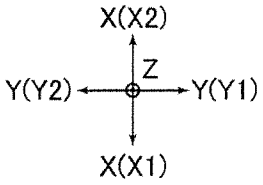

INKJET PRINTER AND CONTROL METHOD FOR INKJET PRINTER

CROSS REFERENCE TO RELATED APPLICATIONS

This application claims the priority benefit of Japanese Patent Application No. 2020-006475, filed on Jan. 20, 2020. The entirety of the above-mentioned patent application is hereby incorporated by reference herein and made a part of this specification.

TECHNICAL FIELD

The present disclosure relates to an inkjet printer that performs printing on a print medium by ejecting ultraviolet-curable ink. The present disclosure also relates to a control method for such an inkjet printer.

DESCRIPTION OF THE BACKGROUND ART

An inkjet printer that performs printing through a multi-pass method on a print medium is conventionally known (see e.g., Japanese Unexamined Patent Publication No. 2015-214133, i.e., Patent Literature 1). The inkjet printer described in Japanese Unexamined Patent Publication No. 2015-214133 has a head portion that ejects ink to a print medium, a carriage on which the head portion is mounted, and a scanning driving portion that causes the head portion to perform a main scanning operation and a sub-scanning operation. The head portion includes a plurality of color ink heads that eject ultraviolet curable color ink, a clear ink head that ejects ultraviolet curable clear ink, and an ultraviolet irradiator that cures the ink by irradiating the ink ejected from the color ink head and the clear ink head with ultraviolet rays.

The inkjet printer described in Japanese Unexamined Patent Publication No. 2015-214133 performs printing on a print medium through a printing method including a first step of printing color ink and clear ink on a print medium in a matte tone, and a second step of printing clear ink in a gloss tone on the color ink and the clear ink printed in a matte tone. In the first step, for the surface of the ink layer to become uneven, the color ink and the clear ink are irradiated with ultraviolet rays having a predetermined illuminance immediately after the color ink and the clear ink land on the print medium to main-cure the color ink and the clear ink. On the other hand, in the second step, for the surface of the ink layer to become flat, after the clear ink has landed on the ink layer formed in the first step, the clear ink is irradiated with ultraviolet rays having a predetermined illuminance after a predetermined time has elapsed and the clear ink has wet-spread to main-cure the clear ink.

Patent Literature 1: Japanese Unexamined Patent Publication No. 2015-214133

The inventor of the present application has considered, disposing a color ink ejection portion that ejects ultraviolet curable color ink and a clear ink ejection portion that ejects ultraviolet curable clear ink so as to be offset in the sub-scanning direction, and while moving the carriage in the main scanning direction, printing the color ink on the print medium and printing the clear ink on the printed color ink in a gloss tone. Specifically, the inventor of the present application has considered disposing the clear ink ejection portion on the downstream side of the color ink ejection portion in the direction of relative movement of the print medium with respect to the carriage, and performing together (simultaneously) the printing by the color ink and the printing by the clear ink onto the color ink in a gloss tone during the operation of the carriage in the main scanning direction.

In this case, in order to prevent bleeding of the color ink when the clear ink lands on the ink layer of the color ink, the color ink needs to be irradiated with ultraviolet rays having a predetermined illuminance immediately after the color ink has landed on the print medium to main-cure the color ink before the clear ink is printed on the color ink.

On the other hand, in order to flatten the surface of the ink layer of the clear ink, after the clear ink has landed on the ink layer of the color ink, the clear ink needs to be irradiated with ultraviolet rays having a predetermined illuminance after a predetermined time has elapsed and the clear ink has wet-spread to main-cure the clear ink. Therefore, according to the study of the inventor of the present application, when the color ink is printed on the print medium and the clear ink is printed on the printed color ink in a gloss tone while moving the carriage in the main scanning direction, the print conditions that can ensure the print quality of the print medium are limited.

The present disclosure thus provides an inkjet printer that performs printing on a print medium by ejecting ultraviolet-curable ink, the inkjet printer capable of widening the range of print conditions that can ensure the print quality of the print medium even when performing printing in a gloss tone printing mode of, while moving the carriage in the main scanning direction, printing at least the color ink on the print medium and printing the clear ink on the printed color ink in a gloss tone. The present disclosure also provides a control method for an inkjet printer capable of widening the range of print conditions that can ensure the print quality of a print medium even when printing in the gloss tone printing mode in an inkjet printer that performs printing on a print medium by ejecting ultraviolet-curable ink.

SUMMARY

In order to solve the above problems, an inkjet printer of the present disclosure relates to an inkjet printer that performs printing on a print medium through a multi-pass method, the inkjet printer including an ink ejection portion configured to eject an ultraviolet-curable ink toward a print medium, an ultraviolet irradiator configured to cure the ultraviolet-curable ink by irradiating the ultraviolet-curable ink ejected from the ink ejection portion with ultraviolet rays, a carriage on which the ink ejection portion and the ultraviolet irradiator are mounted, a carriage drive mechanism configured to reciprocate the carriage in a main scanning direction, and a feeding mechanism configured to relatively feed the print medium in a front-back direction orthogonal to an up-down direction and the main scanning direction with respect to the carriage, in which a movement of the carriage in the main scanning direction and a relative feeding of the print medium in a forward direction with respect to the carriage are alternately carried out over a plurality of times, where the ink ejection portion and the ultraviolet irradiator are arranged adjacent to each other in the main scanning direction, the ink ejection portion includes a color ink ejection portion configured to eject a color ink and a clear ink ejection portion configured to eject a clear ink, the clear ink ejection portion is disposed on a front side of the color ink ejection portion in the front-back direction, setting a mode of printing in a gloss tone that is a gloss tone printing mode, in which while the carriage is moved in the main scanning direction, at least the color ink is ejected to the print medium, and the color ink that is ejected is irradiated with ultraviolet rays to perform printing, and the clear ink is ejected on the color ink that is printed, the feeding mechanism relatively feeds the print medium in the forward direction with respect to the carriage by a band width that is constant at the time of printing in the gloss tone printing mode, the ultraviolet irradiator includes a first irradiation portion that is disposed at the same position as the color ink ejection portion in the front-back direction and irradiates the color ink ejected to the print medium with ultraviolet rays at the time of printing in the gloss tone printing mode, and a third irradiation portion that is disposed on a front side of the clear ink ejection portion in the front-back direction and irradiates the clear ink ejected and flattened on the color ink with ultraviolet rays at the time of printing in the gloss tone printing mode, the first irradiation portion is configured by a fourth irradiation portion that forms a back side portion in the front-back direction and a fifth irradiation portion that forms a front side portion in the front-back direction, width of the third irradiation portion, the fourth irradiation portion, and the fifth irradiation portion in the front-back direction are greater than or equal to the band width, and an average illuminance of the fifth irradiation portion is lower than an average illuminance of the fourth irradiation portion at the time of printing in the gloss tone printing mode.

Furthermore, in order to solve the above problems, a control method for an inkjet printer of the present disclosure relates to a control method for an inkjet printer that performs printing on a print medium through a multi-pass method, the inkjet printer including an ink ejection portion configured to eject an ultraviolet-curable ink toward a print medium, an ultraviolet irradiator configured to cure the ultraviolet-curable ink by irradiating the ultraviolet-curable ink ejected from the ink ejection portion with ultraviolet rays, a carriage on which the ink ejection portion and the ultraviolet irradiator are mounted, a carriage drive mechanism configured to reciprocate the carriage in a main scanning direction, and a feeding mechanism configured to relatively feed the print medium in a front-back direction orthogonal to an up-down direction and the main scanning direction with respect to the carriage, in which a movement of the carriage in the main scanning direction and a relative feeding of the print medium in a forward direction with respect to the carriage are alternately carried out over a plurality of times, where the ink ejection portion and the ultraviolet irradiator are arranged adjacent to each other in the main scanning direction, the ink ejection portion includes a color ink ejection portion configured to eject a color ink and a clear ink ejection portion configured to eject a clear ink, the clear ink ejection portion is disposed on a front side of the color ink ejection portion in the front-back direction, setting a mode of printing in a gloss tone that is a gloss tone printing mode, in which while the carriage is moved in the main scanning direction, at least the color ink is ejected to the print medium, and the color ink that is ejected is irradiated with ultraviolet rays to perform printing, and the clear ink is ejected on the color ink that is printed, the feeding mechanism relatively feeds the print medium in the forward direction with respect to the carriage by a band width that is constant at the time of printing in the gloss tone printing mode, the ultraviolet irradiator includes a first irradiation portion that is disposed at the same position as the color ink ejection portion in the front-back direction and irradiates the color ink ejected to the print medium with ultraviolet rays at the time of printing in the gloss tone printing mode, and a third irradiation portion that is disposed on a front side of the clear ink ejection portion in the front-back direction and irradiates with ultraviolet rays the clear ink ejected and flattened on the color ink at the time of printing in the gloss tone printing mode, the first irradiation portion is configured by a fourth irradiation portion that forms a back side portion in the front-back direction and a fifth irradiation portion that forms a front side portion in the front-back direction, width of the third irradiation portion, the fourth irradiation portion, and the fifth irradiation portion in the front-back direction is greater than or equal to the band width, and an average illuminance of the fifth irradiation portion is lower than an average illuminance of the fourth irradiation portion at the time of printing in the gloss tone printing mode.

In an embodiment of the present disclosure, the ultraviolet irradiator includes a first irradiation portion that is disposed at the same position as the color ink ejection portion in the front-back direction and irradiates the color ink ejected to the print medium with ultraviolet rays at the time of printing in the gloss tone printing mode, and a third irradiation portion that is disposed on a front side of the clear ink ejection portion in the front-back direction and irradiates the clear ink ejected and flattened on the color ink at the time of printing in the gloss tone printing mode, where the first irradiation portion is configured by a fourth irradiation portion that forms a back side portion in the front-back direction and a fifth irradiation portion that forms a front side portion in the front-back direction.

Furthermore, in an embodiment of the present disclosure, an average illuminance of the fifth irradiation portion is lower than an average illuminance of the fourth irradiation portion at the time of printing in the gloss tone printing mode. That is, in the present disclosure, the average illuminance of the fourth irradiation portion is higher than the average illuminance of the fifth irradiation portion at the time of printing in the gloss tone printing mode. Therefore, in the present disclosure, at the time of printing in the gloss tone printing mode, under various print conditions, the color ink can be irradiated with ultraviolet rays having a predetermined illuminance immediately after the color ink has landed on the print medium to main-cure the color ink before the clear ink is printed on the color ink.

Furthermore, in the present embodiment, since the average illuminance of the fifth irradiation portion is lower than the average illuminance of the fourth irradiation portion at the time of printing in the gloss tone printing mode, the influence of the leakage light of the ultraviolet rays emitted from the fifth irradiation portion disposed on the front side of the fourth irradiation portion on the clear ink printed on the color ink can be reduced. Therefore, in the present embodiment, at the time of printing in the gloss tone printing mode, under various print conditions, after the clear ink has landed on the ink layer of the color ink, the clear ink can be irradiated with ultraviolet rays having a predetermined illuminance after a predetermined time has elapsed and the clear ink has wet-spread to main-cure the clear ink.

As described above, in an embodiment of the present disclosure, at the time of printing in the gloss tone printing mode, under various print conditions, the color ink can be irradiated with ultraviolet rays having a predetermined illuminance immediately after the color ink has landed on the print medium to main-cure the color ink before the clear ink is printed on the color ink, and after the clear ink has landed on the ink layer of the color ink, the clear ink is irradiated with ultraviolet rays having a predetermined illuminance after a predetermined time has elapsed and the clear ink has wet-spread to main-cure the clear ink. Therefore, in the present disclosure, the range of print conditions that can ensure the print quality of the print medium can be widened even when printing in the gloss tone printing mode.

In an embodiment of the present disclosure, at the time of printing in the gloss tone printing mode, the first irradiation portion is configured to emit ultraviolet rays to an extent that the color ink does not bleed due to the clear ink ejected on the color ink ejected to the print medium.

In an embodiment of the present disclosure, the color ink ejection portion and the clear ink ejection portion are disposed close to each other in the front-back direction, and the clear ink is irradiated with leakage light from the fifth irradiation portion at the time of printing in the gloss tone printing mode.

In an embodiment of the present disclosure, an average illuminance of the fifth irradiation portion is an illuminance that allows the clear ink to be flattened, when the clear ink is irradiated with the leakage light from the fifth irradiation portion at the time of printing in the gloss tone printing mode.

In an embodiment of the present disclosure, preferably, the ultraviolet irradiator includes a second irradiation portion that is disposed at the same position as the clear ink ejection portion in the front-back direction, and an average illuminance of the second irradiation portion is an illuminance that allows the clear ink to be flattened at the time of printing in the gloss tone printing mode. With this configuration, at the time of printing in the gloss tone printing mode, under various print conditions, after the clear ink has landed on the ink layer of the color ink, the clear ink can be irradiated with ultraviolet rays having a predetermined illuminance after a predetermined time has elapsed and the clear ink has wet-spread to main-cure the clear ink.

In addition, if the number of passes when performing printing on the print medium through the multi-pass method decreases, the cumulative light quantity cannot be secured only by controlling the leakage light from the fifth irradiation portion, and although the quality of blank character printing by clear ink cannot be ensured, with this configuration, the second irradiation portion makes it possible to secure the irradiation light quantity and to irradiate the entire surface with uniform ultraviolet rays. That is, although the irradiation light quantity of the ultraviolet rays becomes non-uniform depending on the location with the leakage light from the fifth irradiation portion, with this configuration, the second irradiation portion makes it possible to secure the irradiation light quantity and to irradiate the entire surface with uniform ultraviolet rays. Therefore, it becomes possible to finely control the precuring of the clear ink, and as a result, the balance between the flattening and curing of the clear ink can be accurately controlled and the print quality can be improved.

In an embodiment of the present disclosure, preferably, the ultraviolet irradiator includes a second irradiation portion that is disposed at the same position as the clear ink ejection portion in the front-back direction, a back end of the second irradiation portion is in contact with a front end of the fifth irradiation portion, a width of the second irradiation portion in the front-back direction is greater than or equal to the band width, and at the time of printing in the gloss tone printing mode, an average illuminance of the second irradiation portion is lower than an average illuminance of the fifth irradiation portion, and an average illuminance of the third irradiation portion is higher than the average illuminance of the second irradiation portion.

With this configuration, since the average illuminance of the fifth irradiation portion is higher than the average illuminance of the second irradiation portion, at the time of printing in the gloss tone printing mode, under various print conditions, the color ink can be irradiated with ultraviolet rays having a predetermined illuminance immediately after the color ink has landed on the print medium to main-cure the color ink before the clear ink is printed on the color ink. Furthermore, with this configuration, the average illuminance of the second irradiation portion is lower than the average illuminance of the fifth irradiation portion, and the average illuminance of the third irradiation portion is higher than the average illuminance of the second irradiation portion, and hence at the time of printing in the gloss tone printing mode, under various print conditions, after the clear ink has landed on the ink layer of the color ink, the clear ink can be irradiated with ultraviolet rays having a predetermined illuminance after a predetermined time has elapsed and the clear ink has wet-spread to main-cure the clear ink.

In an embodiment of the present disclosure, it is preferable that the second irradiation portion is turned off during printing in the gloss tone printing mode. With this configuration, since the ultraviolet rays are not emitted from the second irradiation portion disposed at the same position as the clear ink ejection portion in the front-back direction, the time required for the clear ink to be sufficiently wet-spread can be secured.

In an embodiment of the present disclosure, preferably, the ultraviolet irradiator includes a sixth irradiation portion that is disposed between the second irradiation portion and the third irradiation portion in the front-back direction, a width of the sixth irradiation portion in the front-back direction is greater than or equal to the band width, a back end of the sixth irradiation portion is in contact with a front end of the second irradiation portion, and at the time of printing in the gloss tone printing mode, an average illuminance of the sixth irradiation portion is lower than an average illuminance of the third irradiation portion. With this configuration, since the sixth irradiation portion having a lower average illuminance than the average illuminance of the third irradiation portion is disposed between the second irradiation portion and the third irradiation portion, the time required for the clear ink to be sufficiently wet-spread can be secured.

In an embodiment of the present disclosure, preferably, the fifth irradiation portion is configured by a seventh irradiation portion forming a back side portion of the fifth irradiation portion and an eighth irradiation portion forming a front side portion of the fifth irradiation portion; width of the seventh irradiation portion and the eighth irradiation portion in the front-back direction is greater than or equal to the band width; and at the time of printing in the gloss tone printing mode, an average illuminance of the eighth irradiation portion is lower than an average illuminance of the seventh irradiation portion. With this configuration, at the time of printing in the gloss tone printing mode, the leakage light of ultraviolet rays emitted from the fifth irradiation portion allows the clear ink to easily main-cure before the clear ink is printed on the color ink while suppressing the clear ink printed on the color ink from being cured by the leakage light of ultraviolet rays emitted from the fifth irradiation portion. Therefore, it is possible to further widen the range of print conditions that can ensure the print quality of the print medium.

In an embodiment of the present disclosure, preferably, the third irradiation portion is configured by a plurality of divided irradiation portions divided in the front-back direction; width of the divided irradiation portions in the front-back direction is greater than or equal to the band width; and at the time of printing in the gloss tone printing mode, an average illuminance of each of the divided irradiation portions gradually becomes higher from a back side to the front side. With this configuration, the ultraviolet rays emitted from the third irradiation portion can reliably main-cure the clear ink printed on the color ink while suppressing the clear ink printed on the color ink from being cured by the leakage light of ultraviolet rays emitted from the third irradiation portion. Therefore, it is possible to further widen the range of print conditions that can ensure the print quality of the print medium.

As described above, according to an embodiment of the present disclosure, in an inkjet printer that performs printing on a print medium by ejecting ultraviolet-curable ink, the range of print conditions that can ensure the print quality of the print medium can be widened even when performing printing in a gloss tone printing mode of, while moving the carriage in the main scanning direction, printing at least the color ink on the print medium and printing the clear ink on the printed color ink in a gloss tone.

BRIEF DESCRIPTION OF THE DRAWINGS

FIGS. 4A and 4B are views for describing a printing method when performing printing on a print medium in a gloss tone printing mode by the inkjet printer shown in FIG. 1.

FIGS. 5A and 5B are views for describing a printing method when performing printing on a print medium in the gloss tone printing mode by the inkjet printer shown in FIG. 1.

DETAILED DESCRIPTION OF EMBODIMENTS

Hereinafter, an embodiment of the present disclosure will be described with reference to the drawings.

(Configuration of Inkjet Printer)

Figure 1:
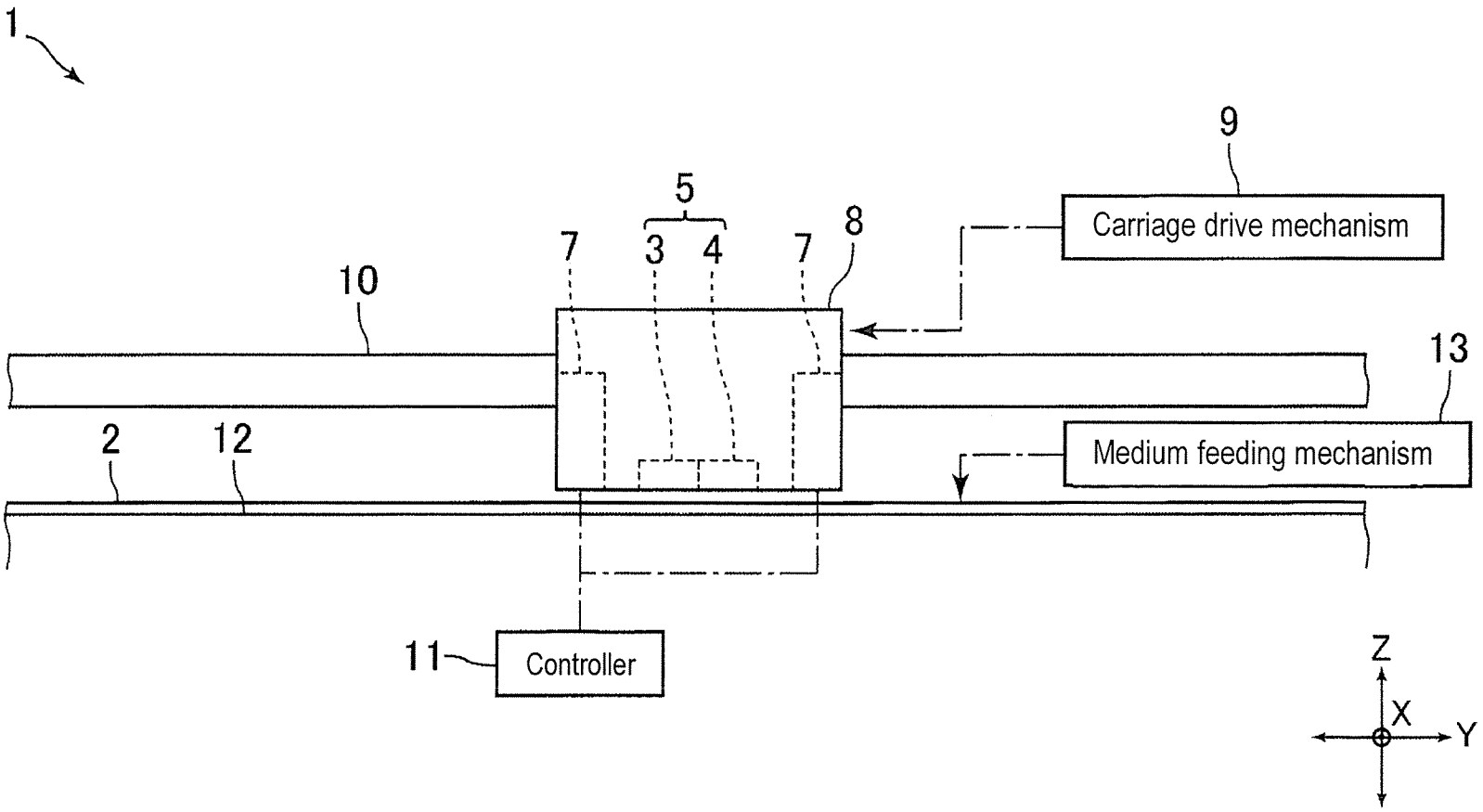
FIG. 1 is a schematic view for describing a configuration of an inkjet printer according to an embodiment of the present disclosure.
Figure 2:
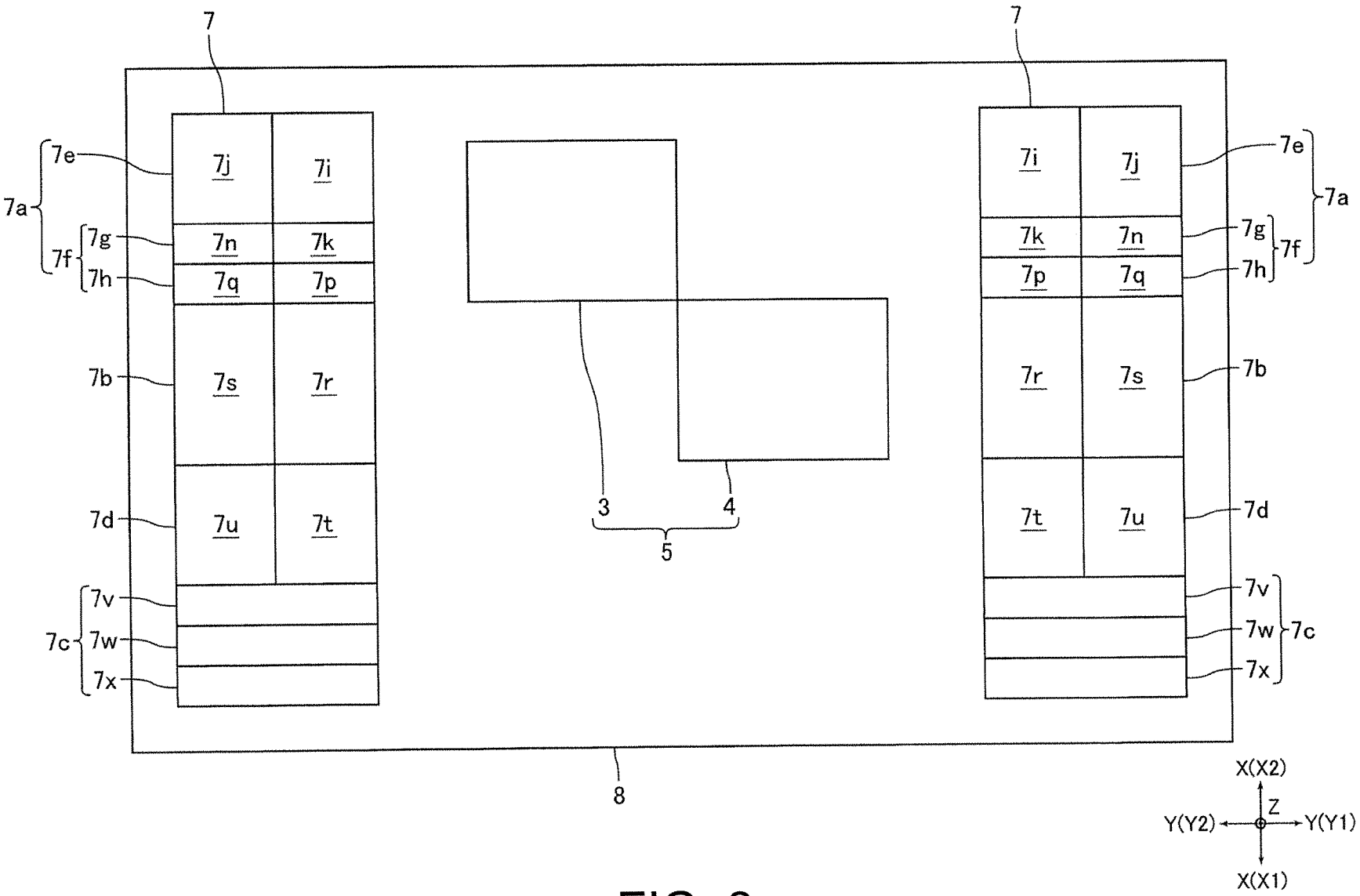
FIG. 2 is a bottom view for describing configurations of an inkjet head and an ultraviolet irradiator shown in FIG. 1.
Figure 3:
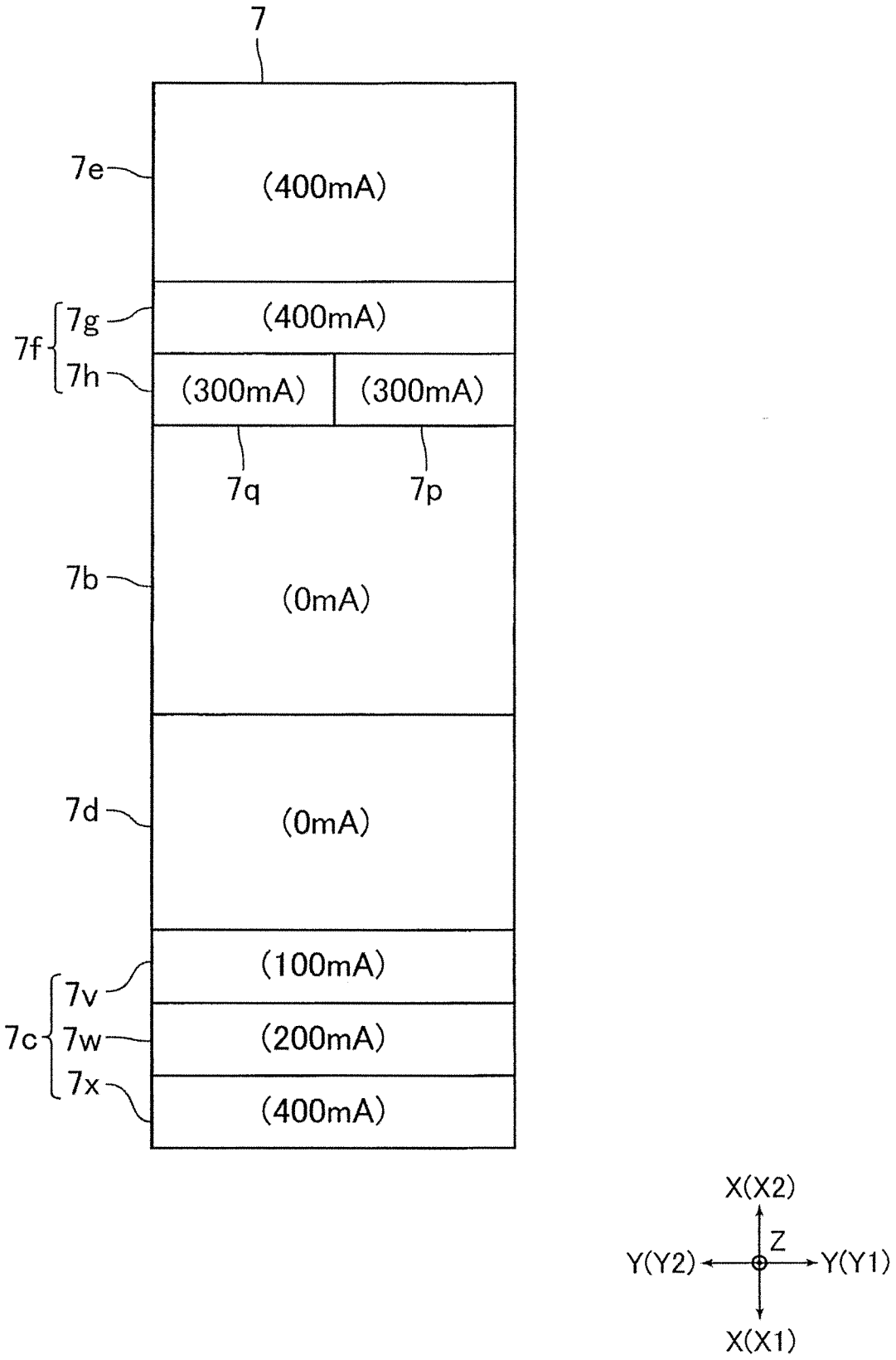
FIG. 3 is a view for describing an example of a value of current supplied to the ultraviolet irradiator when performing printing on a print medium in a gloss tone printing mode with the inkjet printer shown in FIG. 1.

FIG. 1 is a schematic view for describing a configuration of an inkjet printer 1 according to an embodiment of the present disclosure. FIG. 2 is a bottom view for describing configurations of inkjet heads 3 and 4 and an ultraviolet irradiator 7 shown in FIG. 1. FIG. 3 is a view for describing an example of a value of current supplied to the ultraviolet irradiator 7 when performing printing on a print medium 2 in a gloss tone printing mode by the inkjet printer 1 shown in FIG. 1.

The inkjet printer 1 (hereinafter referred to as "printer 1") of the present embodiment is a business inkjet printer, and performs printing on a print medium 2. The print medium 2 is printing paper, fabric, resin film, or the like. The printer 1 includes an inkjet head 3 (hereinafter referred to as "head 3") and an inkjet head 4 (hereinafter referred to as "head 4") that eject ultraviolet-curable ink (UV ink) toward the print medium 2. That is, the printer 1 includes two heads 3 and 4. In the present embodiment, the head 3 and the head 4 form an ink ejection portion 5 that ejects ultraviolet-curable ink toward the print medium 2.

Furthermore, the printer 1 includes an ultraviolet irradiator 7 that cures the ink by irradiating the ink ejected from the heads 3 and 4 (i.e., the ink ejected from the ink ejection portion 5) with ultraviolet rays, a carriage 8 on which the heads 3, 4 and the ultraviolet irradiator 7 are mounted, a carriage drive mechanism 9 that reciprocates the carriage 8 in a main scanning direction (Y direction in FIG. 1 etc.), a guide rail 10 that guides the carriage 8 in the main scanning direction, and a controller 11 that controls the ultraviolet irradiator 7.

Moreover, the printer 1 includes a platen 12 on which the print medium 2 in printing is placed, and a medium feeding mechanism 13 that feeds the print medium 2 in a front-back direction (sub-scanning direction, X direction in FIG. 1 etc.) orthogonal to the up-down direction (Z direction in FIG. 1 etc.) and the main scanning direction. The medium feeding mechanism 13 of the present embodiment is a feeding mechanism that relatively feeds the print medium 2 with respect to the carriage 8 in the front-back direction. In the following description, the main scanning direction (Y direction) is defined as the "left-right direction". Furthermore, the Y1 direction side of FIG. 2 or the like which is one side in the left-right direction is defined as the "right" side, the Y2 direction side of FIG. 2 or the like on the opposite side is defined as the "left" side, the X1 direction side of FIG. 2 or the like which is one side in the front-back direction is defined as the "front" side, and the X2 direction side of FIG. 2 or the like on the opposite side is defined as the "back" side. In the present embodiment, the print medium 2 is fed in the forward direction at the time of printing of the print medium 2.

Note that the printer 1 may include a table on which the print medium 2 is placed and a table feeding mechanism that feeds the table in the front-back direction instead of the platen 12 and the medium feeding mechanism 13. The table feeding mechanism in this case is a feeding mechanism that relatively feeds the print medium 2 with respect to the carriage 8 in the front-back direction. Furthermore, the printer 1 may include, instead of the platen 12 and the medium feeding mechanism 13, a table on which the print medium 2 is placed and a Y bar feeding mechanism for feeding the Y bar, on which the carriage 8 and the guide rail 10 are mounted, in the front-back direction. The Y-bar feeding mechanism in this case is a feeding mechanism that relatively feeds the print medium 2 with respect to the carriage 8 in the front-back direction.

The carriage 8 is disposed on the upper side of the platen 12. The heads 3 and 4 mounted on the carriage 8 eject ink toward the upper surface of the print medium 2 mounted on the platen 12. The carriage drive mechanism 9 includes two pulleys, a belt that is bridged between the two pulleys and that has one part fixed to the carriage 8, and a motor that rotates the pulleys. The medium feeding mechanism 13 includes a drive roller that comes into contact with one surface of the print medium 2, a driven roller that is disposed to face the drive roller and that comes into contact with the other surface of the print medium 2, a motor that rotates the drive roller, and the like.

A nozzle row for ejecting ink toward the print medium 2 is formed on the lower surfaces of the heads 3 and 4. The nozzle row is formed by a plurality of nozzles arrayed in the front-back direction. In the present embodiment, a plurality of nozzle rows arrayed in the left-right direction are formed on the lower surfaces of the heads 3 and 4. The heads 3, 4 include a piezoelectric element (piezoelectric element) that ejects ink from the nozzles. The head 3 ejects ultraviolet curable color ink. The head 4 ejects ultraviolet curable clear ink.

The head 3 and the head 4 are disposed at positions offset from each other in the front-back direction and the left-right direction. In the present embodiment, the head 4 is disposed on the front side of the head 3 and on the right side of the head 3. Furthermore, the front end of the head 3 and the back end of the head 4 are disposed at the same position in the front-back direction. That is, the head 3 and the head 4 are disposed close to each other in the front-back direction. Furthermore, the right end of the head 3 and the left end of the head 4 are disposed at the same position in the left-right direction. The width of the head 3 in the front-back direction and the width of the head 4 in the front-back direction are equal to each other. Moreover, the width of the nozzle row of the head 3 in the front-back direction and the width of the nozzle row of the head 4 in the front-back direction are equal to each other.

In the printer 1, printing can be performed on the print medium 2 in a gloss tone printing mode of, while moving the carriage 8 in the left-right direction, ejecting color ink to the print medium 2 and irradiating the ejected color ink with ultraviolet rays to perform printing and ejecting clear ink on the printed color ink to print in a gloss tone. That is, in the printer 1, printing can be performed on the print medium 2 in the gloss tone printing mode in which the gloss tone clear ink layer is printed in an overlapping manner on the color ink layer. In the gloss tone printing mode, the color ink is printed in a matte tone. However, in the gloss tone printing mode, the color ink may not be printed in a matte tone.

The head 3 in the present embodiment is a color ink ejection portion that ejects color ink (i.e., the color ink forming the color ink layer) in the gloss tone printing mode, and the head 4 is a clear ink ejection portion that ejects clear ink (i.e., the clear ink forming the gloss tone clear ink layer) printed in a gloss tone in the gloss tone printing mode.

Furthermore, the printer 1 alternately performs moving of the carriage 8 in the main scanning direction and feeding of the print medium 2 in the forward direction over a plurality of times to perform printing on the print medium 2 through a multi-pass method. The medium feeding mechanism 13 feeds the print medium 2 in the forward direction by a constant band width BW at the time of printing in the gloss tone printing mode (see FIGS. 4A and 4B, etc.). That is, the medium feeding mechanism 13 relatively feeds the print medium 2 in the forward direction with respect to the carriage 8 by a band width BW at the time of printing in the gloss tone printing mode. When the printer 1 performs printing on the print medium 2 in 4 passes, the band width BW is ¼ of the width in the front-back direction of the heads 3 and 4. Hereinafter, the configuration and the like of the ultraviolet irradiator 7 when the printer 1 performs printing on the print medium 2 in 4 passes will be described.

The ultraviolet irradiator 7 is mounted on the carriage 8 on both sides of the heads 3 and 4 in the left-right direction. That is, the carriage 8 is mounted with two ultraviolet irradiators 7 disposed on both sides of the ink ejection portion 5 in the left-right direction, where the ink ejection portion 5 and the ultraviolet irradiator 7 are arranged adjacent to each other in the left-right direction. The ultraviolet irradiator 7 includes a plurality of light emitting elements and a substrate on which the plurality of light emitting elements are mounted. The light emitting element is a UV LED chip that emits ultraviolet rays. The substrate of the present embodiment is formed in a rectangular shape, and is disposed so that the thickness direction of the substrate and the up-down direction coincide with each other, and the long side direction of the substrate and the front-back direction coincide with each other.

The ultraviolet irradiator 7 includes an irradiation portion 7*a* serving as a first irradiation portion disposed at the same position as the head 3 in the front-back direction, an irradiation portion 7*b* serving as a second irradiation portion disposed at the same position as the head 4 in the front-back direction, an irradiation portion 7*c* serving as a third irradiation portion disposed on the front side of the head 4 in the front-back direction and forming a front end portion of the ultraviolet irradiator 7, and an irradiation portion 7*d* serving as a sixth irradiation portion disposed between the irradiation portion 7*b* and the irradiation portion 7*c* in the front-back direction. The ultraviolet irradiator 7 of the present embodiment is formed by the irradiation portions 7*a* to 7*d*. The irradiation portions 7*a* to 7*d* are formed in a rectangular shape, and the long side direction of the irradiation portions 7*a* to 7*d* coincides with the left-right direction.

The irradiation portion 7*a* irradiates the color ink ejected to the print medium 2 with ultraviolet rays at the time of printing in the gloss tone printing mode. The irradiation portion 7*a* is formed by an irradiation portion 7*e* serving as a fourth irradiation portion that forms a back side portion of the irradiation portion 7*a* in the front-back direction, and an irradiation portion 7*f* serving as a fifth irradiation portion that forms a front side portion of the irradiation portion 7*a* in the front-back direction. The irradiation portions 7*e* and 7*f* are formed in a rectangular shape, and the long side direction of the irradiation portions 7*e* and 7*f* coincides with the left-right direction. The irradiation portion 7*f* is formed by an irradiation portion 7*g* serving as a seventh irradiation portion that forms a back side portion of the irradiation portion 7*f* and an irradiation portion 7*h* serving as an eighth irradiation portion that forms a front side portion of the irradiation portion 7*g*. The irradiation portions 7*g* and 7*h* are formed in a rectangular shape, and the long side direction of the irradiation portions 7*g* and 7*h* coincides with the left-right direction.

The width of the irradiation portions 7*e* and 7*f* in the front-back direction is greater than or equal to the band width BW. The width of the irradiation portion 7*g* and 7*h* in the front-back direction is greater than or equal to the band width BW. In the present embodiment, the width of the irradiation portion 7*g* in the front-back direction and the width of the irradiation portion 7*h* in the front-back direction are equal. Furthermore, the width of the irradiation portions 7*g* and 7*h* in the front-back direction are equal to the band width BW. That is, the width of the irradiation portion 7*f* in the front-back direction is the width of twice the band width BW. Furthermore, the width of the irradiation portion 7*e* in the front-back direction is slightly wider than the width of twice the band width BW. The front end of the irradiation portion 7*f* (i.e., the front end of the irradiation portion 7*h*) is disposed at the same position as the front end of the head 3 and the back end of the head 4 in the front-back direction.

Furthermore, the irradiation portion 7*e* is formed by irradiation portions 7*i* and 7*j* which are equally divided into two in the left-right direction, the irradiation portion 7*g* is formed by irradiation portions 7*k* and 7*n* which are equally divided into two in the left-right direction, and the irradiation portion 7*h* is formed by two irradiation portions 7*p* and 7*q* which are equally divided into two in the left-right direction. In the ultraviolet irradiator 7 disposed on the right side of the ink ejection portion 5, the irradiation portions 7*i*, 7*k*, and 7*p* are disposed on the left side of the irradiation portions 7*j*, 7*n*, and 7*q*, and in the ultraviolet irradiator 7 disposed on the left side of the ink ejection portion 5, the irradiation portions 7*i*, 7*k*, and 7*p* are disposed on the right side of the irradiation portions 7*j*, 7*n*, and 7*q*.

The back end of the irradiation portion 7*b* is in contact with the front end of the irradiation portion 7*f* (i.e., the front end of the irradiation portion 7*h*), and is disposed at the same position as the front end of the head 3 and the back end of the head 4 in the front-back direction. The width of the irradiation portion 7*b* in the front-back direction is greater than or equal to the band width BW. In the present embodiment, the width of the irradiation portion 7*b* in the front-back direction is the width of four times the band width BW. The front end of the irradiation portion 7*b* is disposed at the same position as the front end of the head 4 in the front-back direction. Furthermore, the irradiation portion 7*b* is formed by irradiation portions 7*r* and 7*s* which are equally divided into two in the left-right direction. In the ultraviolet irradiator 7 disposed on the right side of the ink ejection portion 5, the irradiation portion 7*r* is disposed on the left side of the irradiation portion 7*s*, and in the ultraviolet irradiator 7 disposed on the left side of the ink ejection portion 5, the irradiation portion 7*r* is disposed on the right side of the irradiation portion 7*s*.

The back end of the irradiation portion 7*d* is in contact with the front end of the irradiation portion 7*b*, and is disposed at the same position as the front end of the head 4 in the front-back direction. The width of the irradiation portion 7*d* in the front-back direction is greater than or equal to the band width BW. In the present embodiment, the width of the irradiation portion 7*d* in the front-back direction is the width of three times the band width BW. Furthermore, the irradiation portion 7*d* is formed by irradiation portions 7*t* and 7*u* which are equally divided into two in the left-right direction. In the ultraviolet irradiator 7 disposed on the right side of the ink ejection portion 5, the irradiation portion 7*t* is disposed on the left side of the irradiation portion 7*u*, and in the ultraviolet irradiator 7 disposed on the left side of the ink ejection portion 5, the irradiation portion 7*t* is disposed on the right side of the irradiation portion 7*u*.

The irradiation portion 7*c* irradiates the clear ink ejected onto the color ink and flattened with ultraviolet rays at the time of printing in the gloss tone printing mode. The back end of the irradiation portion 7*c* is in contact with the front end of the irradiation portion 7*d*. The irradiation portion 7*c* is formed by a plurality of irradiation portions 7*v*, 7*w*, and 7*x* which are divided in the front-back direction. The irradiation portion 7*c* of the present embodiment is formed by three irradiation portions 7*v* to 7*x* which are equally divided in the front-back direction. The irradiation portions 7*v* to 7*x* are disposed in this order from the back side to the front side. The width of the irradiation portion 7*c* in the front-back direction is greater than or equal to the band width BW. Furthermore, the width of the irradiation portions 7*v* to 7*x* in the front-back direction is greater than or equal to the band width BW. In the present embodiment, the width of the irradiation portions 7*v* to 7*x* in the front-back direction is equal to the band width BW. That is, the width of the irradiation portion 7*c* in the front-back direction is the width of three times the band width BW. The irradiation portions 7*v* to 7*x* of the present embodiment are divided irradiation portions.

The ultraviolet irradiator 7 is electrically connected to a controller 11. The ultraviolet irradiator 7 is current-controlled by the controller 11. In the present embodiment, each of the irradiation portions 7*i* to 7*k*, 7*n*, and 7*p* to 7*x* can be individually current-controlled. That is, the controller 11 can individually control the illuminance (irradiation intensity) of each of the irradiation portions 7*i* to 7*k*, 7*n*, and 7*p* to 7*x*.

When performing printing on the print medium 2 in the gloss tone printing mode (at the time of printing in the gloss tone printing mode), the heads 3 and 4 eject ink and the ultraviolet irradiation portion 7 irradiates the ink ejected from the heads 3 and 4 with ultraviolet rays while the carriage 8 reciprocates in the left-right direction. At the time of printing in the gloss tone printing mode (more specifically, at the time of printing in the gloss tone printing mode when the ultraviolet irradiation portion 7 irradiates the ink with ultraviolet rays), the average illuminance of the irradiation portion 7*f* is lower than the average illuminance of the irradiation portion 7*e*, the average illuminance of the irradiation portion 7*b* is lower than the average illuminance of the irradiation portion 7*f*, and the average illuminance of the irradiation portion 7*c* is higher than the average illuminance of the irradiation portion 7*b*.

That is, at the time of printing in the gloss tone printing mode, the controller 11 makes the average illuminance of the irradiation portion 7*f* to be lower than the average illuminance of the irradiation portion 7*e*, makes the average illuminance of the irradiation portion 7*b* to be lower than the average illuminance of the irradiation portion 7*f*, and makes the average illuminance of the irradiation portion 7*c* to be higher than the average illuminance of the irradiation portion 7*b*. Furthermore, at the time of printing in the gloss tone printing mode, the average illuminance of the irradiation portion 7*d* is lower than the average illuminance of the irradiation portion 7*c*. In the present embodiment, the average illuminance of the irradiation portion 7*d* is equal to the average illuminance of the irradiation portion 7*b* at the time of printing in the gloss tone printing mode. Moreover, at the time of printing in the gloss tone printing mode, the average illuminance of the irradiation portion 7*h* is lower than the average illuminance of the irradiation portion 7*g*.

Furthermore, at the time of printing in the gloss tone printing mode, the average illuminance of each of the irradiation portions 7*v* to 7*x* gradually increases from the back side toward the front side. That is, at the time of printing in the gloss tone printing mode, the illuminance of the irradiation portion 7*w* is higher than the illuminance of the irradiation portion 7*v*, and the illuminance of the irradiation portion 7*x* is higher than the illuminance of the irradiation portion 7*w*.

As shown in FIG. 3, at the time of printing in the gloss tone printing mode, current of 400 mA is supplied to the irradiation portion 7*e* (i.e., the irradiation portion 7*j*, 7*i*), current of 400 mA is supplied to the irradiation portion 7*g* (i.e., the irradiation portion 7*n*, 7*k*), current of 300 mA is supplied to the irradiation portions 7*q* and 7*p* (i.e., the irradiation portion 7*h*), current of 100 mA is supplied to the irradiation portion 7*v*, current of 200 mA is supplied to the irradiation portion 7*w*, and current of 400 mA is supplied to the irradiation portion 7*x*. Furthermore, in the present embodiment, the irradiation portions 7*b* and 7*d* (i.e., the irradiation portions 7*r* to 7*u*) are turned off during printing in the gloss tone printing mode.

Furthermore, in the example shown in FIG. 3, current of 350 mA or current of 300 mA may be supplied to the irradiation portion 7*g*. Moreover, in the example shown in FIG. 3, current of 200 mA may be supplied to either the irradiation portion 7*p* or the irradiation portion 7*q*, and either one of the irradiation portion 7*p* or the irradiation portion 7*q* may be turned off. Furthermore, in the example shown in FIG. 3, the irradiation portion 7*h* may be turned off. In addition, the value of the current supplied to the irradiation portion 7*i* and the value of the current supplied to the irradiation portion 7*j* may be different, and the value of the current supplied to the irradiation portion 7*k* and the value of the current supplied to the irradiation portion 7*n* may be different.

In the present embodiment, at the time of printing in the gloss tone printing mode, the irradiation portion 7*a* emits ultraviolet rays to the extent that the color ink does not bleed due to the clear ink ejected on the color ink ejected to the print medium 2. Furthermore, at the time of printing in the gloss tone printing mode, the leakage light from the irradiation portion 7*f* is irradiated on the clear ink. At the time of printing in the gloss tone printing mode, the average illuminance of the irradiation portion 7*f* is the irradiation that allows the clear ink to be flattened when the light leaked from the irradiation portion 7*f* is irradiated on the clear ink, and the average illuminance of the irradiation portion 7*b* is the irradiation that allows the clear ink to be flattened.

(Method of Printing on Print Medium in Gloss Tone Printing Mode)

FIGS. 4A to 7B are views for describing a printing method when performing printing on the print medium 2 in the gloss tone printing mode by the printer 1 shown in FIG. 1.

The printing region, which is the region where the print medium 2 is printed, is formed by a plurality of divided printing regions PAs separated by a band width BW in the front-back direction. In the following, when each of the 15 divided printing regions PAs (15 divided printing regions PAs connected in the front-back direction) shown in FIG. 7B is shown individually, each of the 15 divided regions PAs is assumed as divided printing regions PA1 to PA15. The divided printing regions PA1 to PA15 are disposed in this order toward the back side, and the divided printing region PA1 configures the front end portion of the printing region.

When performing printing on the print medium 2 in the gloss tone printing mode, the print medium 2 is first fed in the front-back direction until the back end of the divided printing region PA1 is disposed at the same position as the back end of the head 3 (see FIG. 4A). Thereafter, while moving the carriage 8 in one of the left-right directions (e.g., in the left direction), the color ink is ejected from the head 3 to the divided printing region PA1 and the divided printing region PA1 is irradiated with ultraviolet rays from the irradiation portion 7*e*.

Subsequently, after the print medium 2 is fed in the forward direction by the band width BW, while moving the carriage 8 in the other one of the left-right directions (e.g., in the right direction), the color ink is ejected from the head 3 to the divided printing regions PA1, PA2, and the divided printing regions PA1, PA2 are irradiated with ultraviolet rays from the irradiation portion 7*e*. Thereafter, after the print medium 2 is fed in the forward direction by the band width BW, while moving the carriage 8 in one of the left-right directions, the color ink is ejected from the head 3 to the divided printing regions PA1 to PA3, and the divided printing region PA1 is irradiated with ultraviolet rays from the irradiation portion 7*g* and the divided printing regions PA2, PA3 are irradiated with ultraviolet rays from the irradiation portion 7*e*.

Thereafter, after the print medium 2 is fed in the forward direction by the band width BW, while moving the carriage 8 in the other one of the left-right directions, the color ink is ejected from the head 3 to the divided printing regions PA1 to PA4, and the divided printing region PA1 is irradiated with ultraviolet rays from the irradiation portion 7*h*, the divided printing region PA2 is irradiated with ultraviolet rays from the irradiation portion 7*g*, and the divided printing regions PA3, PA4 are irradiated with ultraviolet rays from the irradiation portion 7*e* (see FIG. 4B). When the divided printing region PA1 is irradiated with ultraviolet rays from the irradiation portion 7*h*, the color ink ejected to the divided printing region PA1 is main-cured.

Subsequently, after the print medium 2 is fed in the forward direction by the band width BW, while moving the carriage 8 in one of the left-right directions, the color ink is ejected from the head 3 to the divided printing regions PA2 to PA5 and the clear ink is ejected from the head 4 to the divided printing region PA1, and the divided printing region PA2 is irradiated with ultraviolet rays from the irradiation portion 7*h*, the divided printing region PA3 is irradiated with ultraviolet rays from the irradiation portion 7*g*, and the divided printing regions PA4, PA5 are irradiated with ultraviolet rays from the irradiation portion 7*e* (see FIG. 5A). When the divided printing region PA2 is irradiated with ultraviolet rays from the irradiation portion 7*h*, the color ink ejected to the divided printing region PA2 is main-cured.

As described above, in the present embodiment, the irradiation portion 7*b* is turned off at the time of printing in the gloss tone printing mode, but in the printing operation shown in FIG. 5A, the leakage light from the irradiation portion 7*f* is irradiated on the divided printing region PA1. Specifically, in the printing operation shown in FIG. 5A, the light leaking from the irradiation portion 7*h* is mainly irradiated on the divided printing region PA1. Thus, in the printing operation shown in FIG. 5A, the clear ink ejected to the divided printing region PA1 is slightly cured by the influence of the leakage light from the irradiation portion 7*f*. That is, in the printing operation shown in FIG. 5A, the clear ink ejected to the divided printing region PA1 is precured.

In the present embodiment, the average illuminance of the irradiation portion 7*f* is set to main cure the color ink ejected to the divided printing region PA2 and to precure the clear ink ejected to the divided printing region PA1. Furthermore, if the clear ink ejected to the divided printing region PA1 is precured excessively, the clear ink does not wet-spread and the clear ink is not printed in a gloss tone, while if the clear ink ejected to the divided printing region PA1 is precured insufficiently, the clear ink wet-spreads too much and bleeds, and hence the average illuminance of the irradiation portion 7*f* is set so that the clear ink ejected to the divided printing region PA1 is appropriately precured.

Subsequently, after the print medium 2 is fed in the forward direction by the band width BW, while moving the carriage 8 in the other one of the left-right directions, the color ink is ejected from the head 3 to the divided printing regions PA3 to PA6 and the clear ink is ejected from the head 4 to the divided printing regions PA1, PA2, and the divided printing region PA3 is irradiated with ultraviolet rays from the irradiation portion 7*h*, the divided printing region PA4 is irradiated with ultraviolet rays from the irradiation portion 7*g*, and the divided printing regions PA5, PA6 are irradiated with ultraviolet rays from the irradiation portion 7*e* (see FIG. 5B).

When the divided printing region PA3 is irradiated with ultraviolet rays from the irradiation portion 7*h*, the color ink ejected to the divided printing region PA3 is main-cured. In the printing operation shown in FIG. 5B, the clear ink ejected to the divided printing region PA2 is temporarily cured by the influence of the light leaking from the irradiation portion 7*f*. In the printing operation shown in FIG. 5B, the clear ink ejected to the divided printing region PA1 may be precured by the influence of the light leaking from the irradiation portion 7*f*.

Figure 6A:
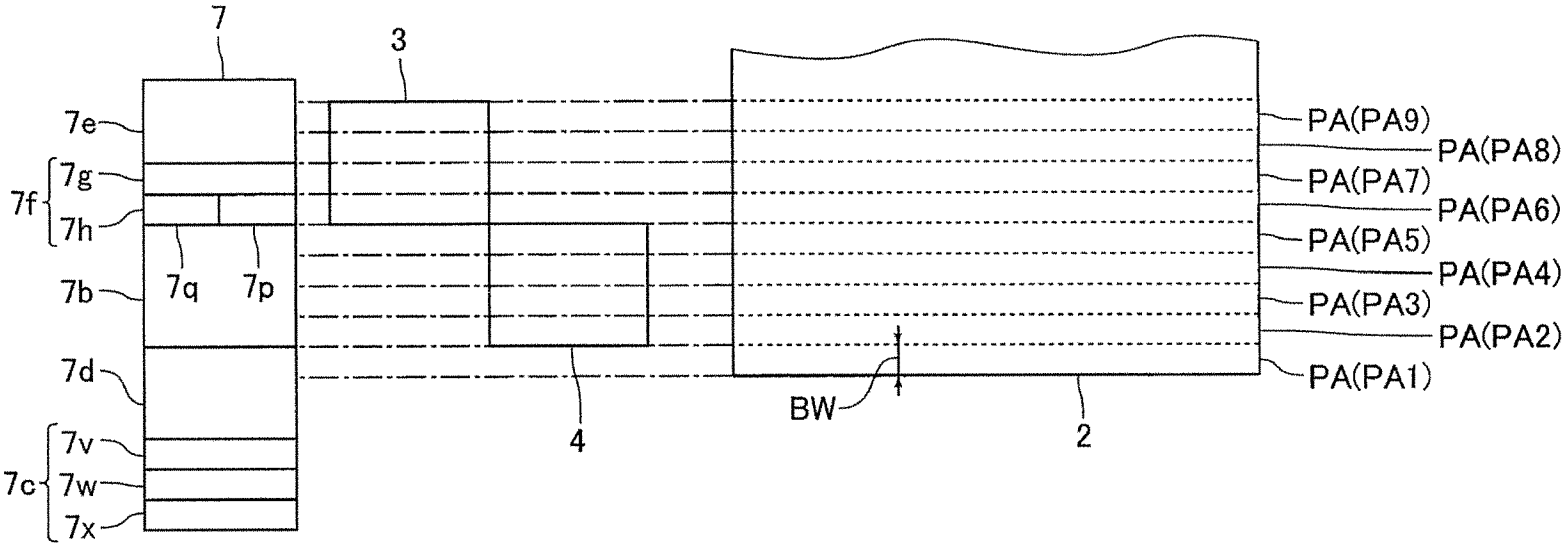
FIGS. 6A and 6B are views for describing a printing method when performing printing on a print medium in the gloss tone printing mode by the inkjet printer shown in FIG. 1.
Figure 6B:
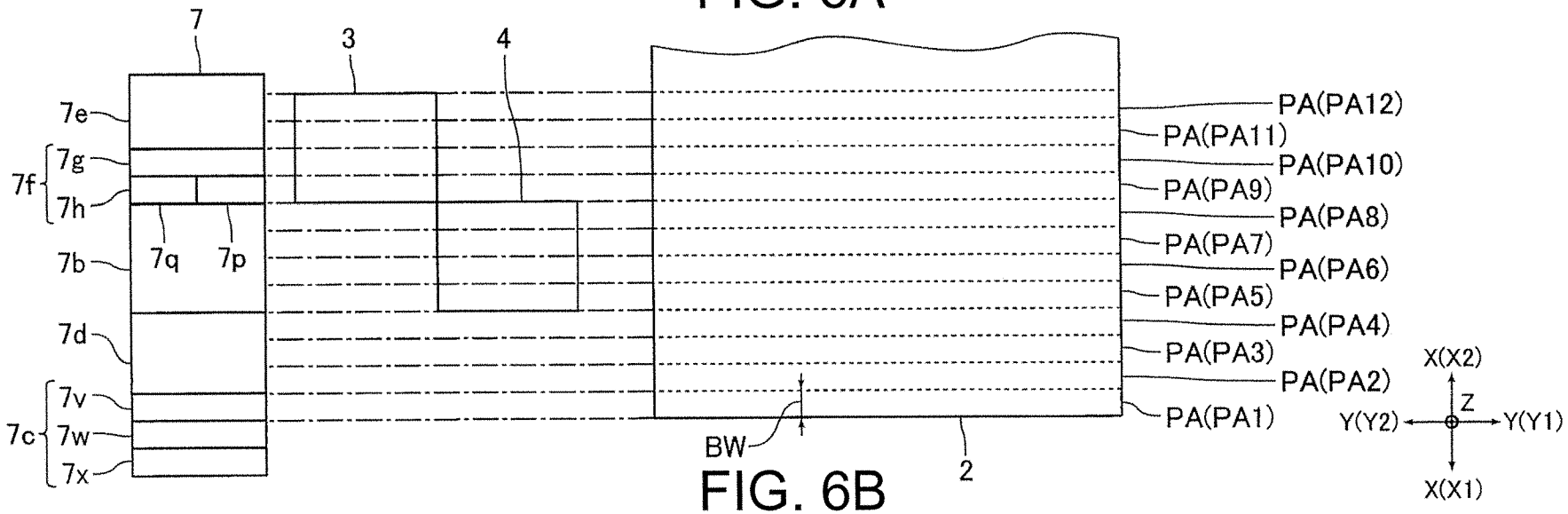

Thereafter, similarly, when the feeding operation of the print medium 2 in the forward direction, and the ejecting operation of ink and irradiating operation of ultraviolet rays while moving the carriage 8 in the left-right direction are alternately repeated (see FIG. 6A), the front end of the divided printing region PA1 eventually reaches the front end of the irradiation portion 7*v* in the front-back direction (see FIG. 6B). In the printing operation shown in FIG. 6B, color ink is ejected from the head 3 to the divided printing regions PA9 to PA12 and clear ink is ejected from the head 4 to the divided printing regions PA5 to PA8, and the divided printing region PA9 is irradiated with ultraviolet rays from the irradiation portion 7*h*, the divided printing region PA10 is irradiated with ultraviolet rays from the irradiation portion 7*g*, and the divided printing regions PA11, PA12 are irradiated with ultraviolet rays from the irradiation portion 7*e*.

Furthermore, in the printing operation shown in FIG. 6B, since the divided printing region PA1 is irradiated with ultraviolet rays from the irradiation portion 7*v*, the clear ink ejected to the divided printing region PA1 starts to main-cure. Since the irradiation portions 7*b* and 7*d* are turned off at the time of printing in the gloss tone printing mode, the clear ink ejected to the divided printing region PA1 is wet-spread before the printing operation shown in FIG. 6B is performed. That is, in the printing operation shown in FIG. 6B, the clear ink that has been ejected to the divided printing region PA1 and wet-spread starts to main-cure. Furthermore, in the printing operation shown in FIG. 6B, the clear ink ejected to the divided printing region PA2 is slightly cured by the influence of the light leaking from the irradiation portion 7*v*.

Figure 7A:
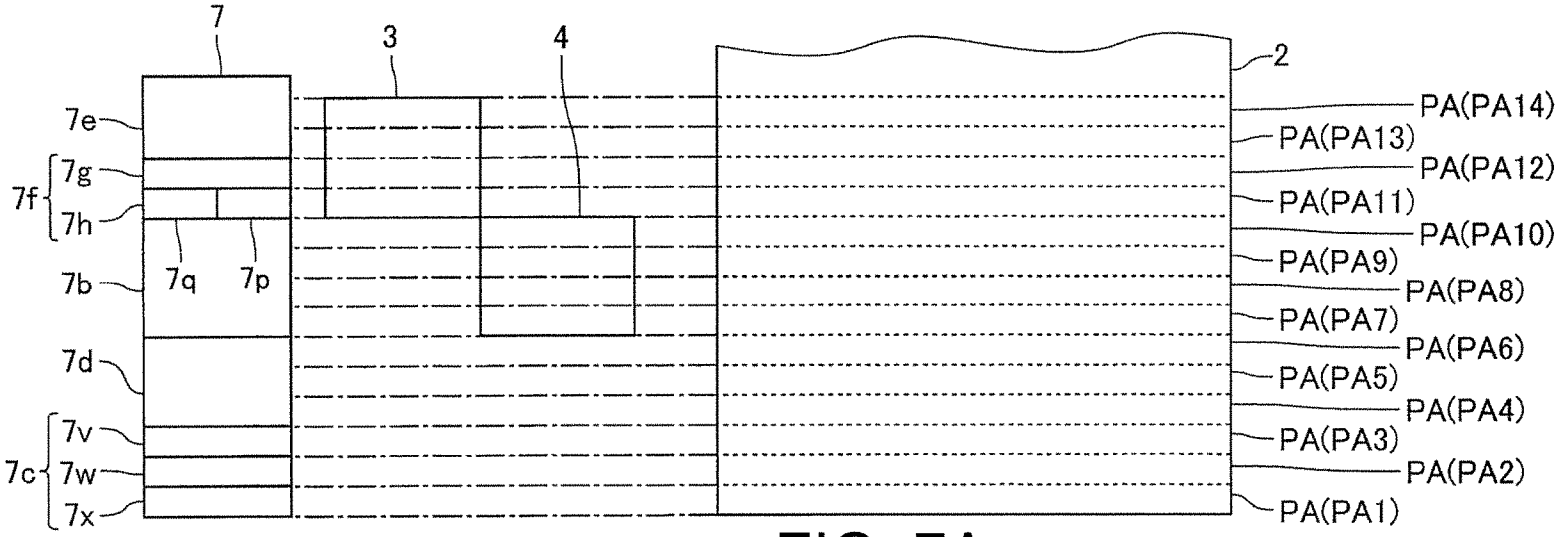
FIGS. 7A and 7B are views for describing a printing method when performing printing on a print medium in the gloss tone printing mode by the inkjet printer shown in FIG. 1.
Figure 7B:
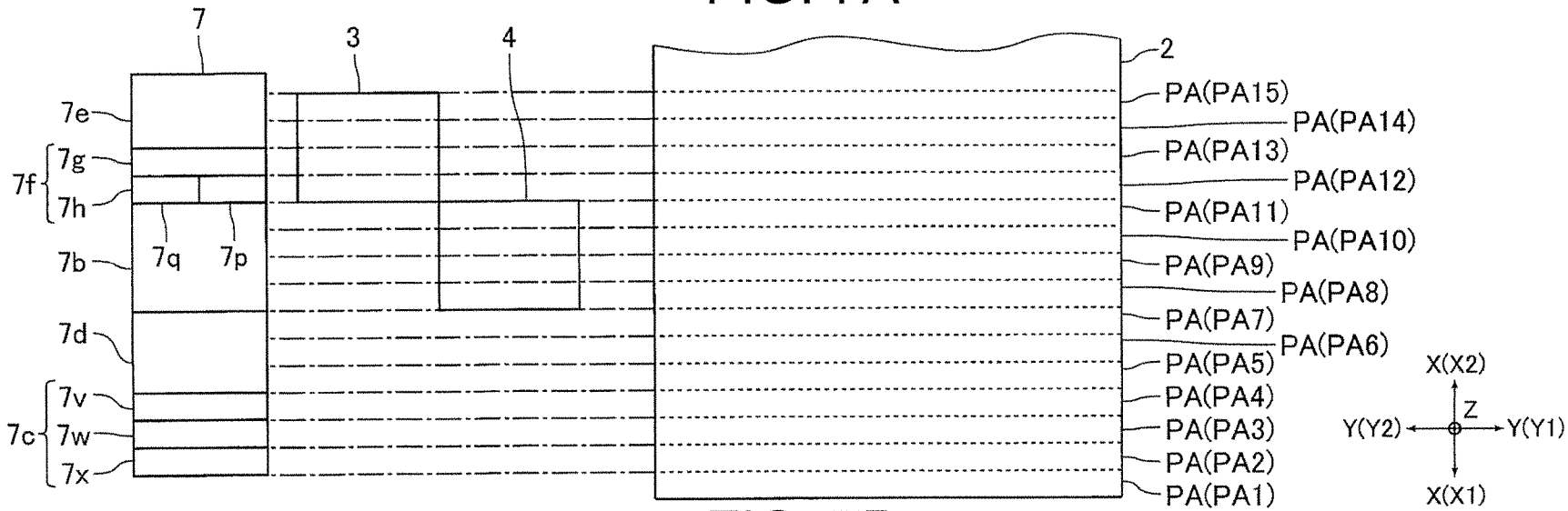

Thereafter, when the feeding operation of the print medium 2 in the forward direction, and the ejecting operation of ink and irradiating operation of ultraviolet rays while moving the carriage 8 in the left-right direction are further alternately repeated, the front end of the divided printing region PA1 eventually reaches the front end of the irradiation portion 7*x* in the front-back direction (see FIG. 7A). In the printing operation shown in FIG. 7A, when the divided printing region PA1 is irradiated with ultraviolet rays from the irradiation portion 7*x*, the clear ink ejected to the divided printing region PA1 is main-cured. When the clear ink ejected to the divided printing region PA1 is main-cured, printing on the divided printing region PA1 is completed. After that, until the printing in the gloss tone printing mode is completed, the feeding operation of the print medium 2 in the forward direction, and the ejecting operation of ink and irradiating operation of ultraviolet rays while moving the carriage 8 in the left-right direction are alternately repeated (see FIG. 7B).

(Main Effect of Present Embodiment)

As described above, in the present embodiment, the irradiation portion 7*a* disposed at the same position in the front-back direction as the head 3 for ejecting the color ink is formed by the irradiation portion 7*e* forming the back side portion of the irradiation portion 7*a* and the irradiation portion 7*f* forming the front side portion of the irradiation portion 7*a*. Furthermore, in the present embodiment, the average illuminance of the irradiation portion 7*e* is higher than the average illuminance of the irradiation portion 7*f* at the time of printing in the gloss tone printing mode. Therefore, in the present embodiment, at the time of printing in the gloss tone printing mode, under various print conditions, the color ink can be irradiated with ultraviolet rays having a predetermined illuminance immediately after the color ink has landed on the print medium 2 to main-cure the color ink before the clear ink is printed on the color ink.

Furthermore, in the present embodiment, since the average illuminance of the irradiation portion 7*f* is lower than the average illuminance of the irradiation portion 7*e* during printing in the gloss tone printing mode, the influence of the leakage light from the irradiation portion 7*f* disposed on the front side of the irradiation portion 7*e* on the clear ink printed on the color ink can be reduced. Therefore, in the present embodiment, at the time of printing in the gloss tone printing mode, under various print conditions, after the clear ink ejected from the head 4 has landed on the ink layer of the color ink, the clear ink is irradiated with ultraviolet rays having a predetermined illuminance after a predetermined time has elapsed and the clear ink has wet-spread to main-cure the clear ink.

As described above, in the present embodiment, at the time of printing in the gloss tone printing mode, under various print conditions, the color ink can be irradiated with ultraviolet rays having a predetermined illuminance immediately after the color ink has landed on the print medium 2 to main-cure the color ink before the clear ink is printed on the color ink, and after the clear ink has landed on the ink layer of the color ink, the clear ink can be irradiated with ultraviolet rays having a predetermined illuminance after a predetermined time has elapsed and the clear ink has wet-spread to main-cure the clear ink. Therefore, in the present embodiment, the range of print conditions that can ensure the print quality of the print medium 2 can be widened even when printing in the gloss tone printing mode.

In the present embodiment, the ultraviolet irradiator 7 includes an irradiation portion 7*b* disposed at the same position as the head 4 in the front-back direction, where the average illuminance of the irradiation portion 7*f* is higher than the average illuminance of the irradiation portion 7*b* when printing in the gloss tone printing mode. Therefore, in the present embodiment, at the time of printing in the gloss tone printing mode, under various print conditions, the color ink can be irradiated with ultraviolet rays having a predetermined illuminance immediately after the color ink has landed on the print medium 2 to main-cure the color ink before the clear ink is printed on the color ink.

Furthermore, in the present embodiment, the average illuminance of the irradiation portion 7*b* is lower than the average illuminance of the irradiation portion 7*f*, and the average illuminance of the irradiation portion 7*c* is higher than the average illuminance of the irradiation portion 7*b*, and the average illuminance of the irradiation portion 7*b* is the illuminance that allows the clear ink to be flattened. Therefore, in the present embodiment, at the time of printing in the gloss tone printing mode, under various print conditions, after the clear ink has landed on the ink layer of the color ink, the clear ink can be irradiated with ultraviolet rays having a predetermined illuminance after a predetermined time has elapsed and the clear ink wetting has wet-spread to main-cure the clear ink.

In the present embodiment, at the time of printing in the gloss tone printing mode, the irradiation portion 7*b* disposed at the same position in the front-back direction as the head 4 that ejects the clear ink is turned off. Therefore, in the present embodiment, it is possible to secure the time required for the clear ink ejected from the head 4 to be sufficiently wet-spread. In particular, in the present embodiment, since the irradiation portion 7*d* is also turned off during printing in the gloss tone printing mode, it is possible to reliably secure the time required for the clear ink to be sufficiently wet-spread.

In the present embodiment, at the time of printing in the gloss tone printing mode, the average illuminance of the irradiation portion 7*h* forming the front side portion of the irradiation portion 7*f* is lower than the average illuminance of the irradiation portion 7*g* forming the back end portion of the irradiation portion 7*f*. Therefore, in the present embodiment, at the time of printing in the gloss tone printing mode, the color ink is easily main-cured before the clear ink is printed on the color ink by the ultraviolet rays emitted from the irradiation portion 7*f* while suppressing the clear ink ejected from the head 4 from being cured by the leakage light of ultraviolet rays emitted from the irradiation portion 7*f*. Therefore, in the present embodiment, it is possible to further widen the range of print conditions that can ensure the print quality of the print medium 2.

In the present embodiment, the irradiation portion 7*c* is configured by three irradiation portions 7*v* to 7*x* divided in the front-back direction, where at the time of printing in the gloss tone printing mode, the average illuminance of each of the irradiation portions 7*v* to 7*x* gradually increases from the back side to the front side. Therefore, in the present embodiment, the clear ink ejected from the head 4 can be reliably main-cured by the ultraviolet rays emitted from the irradiation portion 7*c* while suppressing the clear ink ejected from the head 4 from being cured by the leakage light of the ultraviolet rays emitted from the irradiation portion 7*c*. Therefore, in the present embodiment, it is possible to further widen the range of print conditions that can ensure the print quality of the print medium 2.

Other Embodiments

The embodiment described above is an example of a preferred embodiment of the present disclosure, but the present disclosure is not limited thereto, and various modified examples can be made without changing the gist of the present disclosure.

In the embodiment described above, when the printing operation is performed while moving the carriage 8 in the left direction in the gloss tone printing mode, the irradiation portion 7*h* of the ultraviolet irradiator 7 disposed on the left side may be turned on and the irradiation portion 7*h* of the ultraviolet irradiator 7 disposed on the right side may be turned off. Furthermore, when the printing operation is performed while moving the carriage 8 in the right direction in the gloss tone printing mode, the irradiation portion 7*h* of the ultraviolet irradiator 7 disposed on the right side may be turned on and the irradiation portion 7*h* of the ultraviolet irradiator 7 disposed on the left side may be turned off. In this case, it becomes possible to easily secure the time required for the clear ink ejected from the head 4 to be sufficiently wet-spread.

In the embodiment described above, the illuminance of the irradiation portion 7*v*, the illuminance of the irradiation portion 7*w*, and the illuminance of the irradiation portion 7*x* may be equal at the time of printing in the gloss tone printing mode. Furthermore, in the embodiment described above, the irradiation portion 7*v* may be turned off during printing in the gloss tone printing mode. Moreover, the irradiation portion 7*v* and the irradiation portion 7*w* may be turned off during printing in the gloss tone printing mode. Furthermore, in the embodiment described above, the irradiation portion 7*d* may be turned on or the irradiation portion 7*b* may be turned on during printing in the gloss tone printing mode. In this case, the average illuminance of the irradiation portion 7*b* and the average illuminance of the irradiation portion 7*d* may be different.

If the number of passes when performing printing on the print medium 2 through the multi-pass method decreases, the cumulative light quantity cannot be secured only by controlling the leakage light from the irradiation portion 7*f*, and although the quality of blank character printing by clear ink cannot be ensured, when the irradiation portion 7*b* is turned on, the irradiation portion 7*b* makes it possible to secure the irradiation light quantity and to irradiate the entire surface with uniform ultraviolet rays. That is, although the irradiation light quantity of the ultraviolet rays becomes non-uniform depending on the location with the leakage light from the irradiation portion 7*f*, when the irradiation portion 7*b* is turned on, the irradiation portion 7*b* makes it possible to secure the irradiation light quantity and to irradiate the entire surface with uniform ultraviolet rays. Therefore, it becomes possible to finely control the precuring of the clear ink, and as a result, the balance between the flattening and curing of the clear ink can be accurately controlled and the print quality can be improved.

In the embodiment described above, the width of the irradiation portion 7*g* in the front-back direction and the width of the irradiation portion 7*h* in the front-back direction may be different. Furthermore, in the embodiment described above, some of the irradiation portions 7*v* to 7*x* may have different width in the front-back direction. The width of the irradiation portion 7*x* in the front-back direction may be wider than the width of the irradiation portions 7*v* and 7*w* in the front-back direction.

In the embodiment described above, the irradiation portion 7*e* may be divided into three or more in the left-right direction, or may not be divided in the left-right direction. Similarly, the irradiation portions 7*b*, 7*d*, 7*g*, and 7*h* may be divided into three or more in the left-right direction, or may not be divided in the left-right direction. Furthermore, in the embodiment described above, at least one of the irradiation portions 7*v* to 7*x* may be divided in the left-right direction. Moreover, in the embodiment described above, the irradiation portion 7*f* may not be divided into the irradiation portion 7*g* and the irradiation portion 7*h*.

In the embodiment described above, the irradiation portion 7*e* may be divided into plurals in the front-back direction. Furthermore, in the embodiment described above, the irradiation portions 7*b* and 7*d* may be divided into plurals in the front-back direction. Moreover, in the embodiment described above, the irradiation portion 7*c* may be divided into two in the front-back direction, or may be divided into four or more in the front-back direction. Furthermore, the irradiation portion 7*c* may not be divided in the front-back direction. Furthermore, in the embodiment described above, the ultraviolet irradiator 7 may not include the irradiation portion 7*d* or may not include the irradiation portion 7*b*.

In the embodiment described above, when printing in the gloss tone printing mode, the color ink and the clear ink may be printed on the print medium 2 and the clear ink may be printed on the printed color ink and clear ink in a gloss tone while moving the carriage 8 in the left-right direction, in this case, a head that ejects clear ink is mounted on the carriage 8 at the same position as the head 3 in the front-back direction.

In the embodiment described above, the back end of the head 4 may be disposed on the front side of the front end of the head 3. In this case, the front end of the head 3 may be disposed behind the back end of the irradiation portion 7*b*. Furthermore, in this case, the back end of the head 4 may be disposed on the front side of the back end of the irradiation portion 7*b*. Furthermore, in the embodiment described above, the head 3 and the head 4 may be disposed at the same position in the left-right direction.

In the embodiment described above, the printer 1 may include a plurality of heads 3 that eject color ink. In this case, the ink ejection portion 5 is formed by a plurality of heads 3 and 4. Furthermore, in the gloss tone printing mode, the plurality of heads 3 eject color ink.

Figure 8:
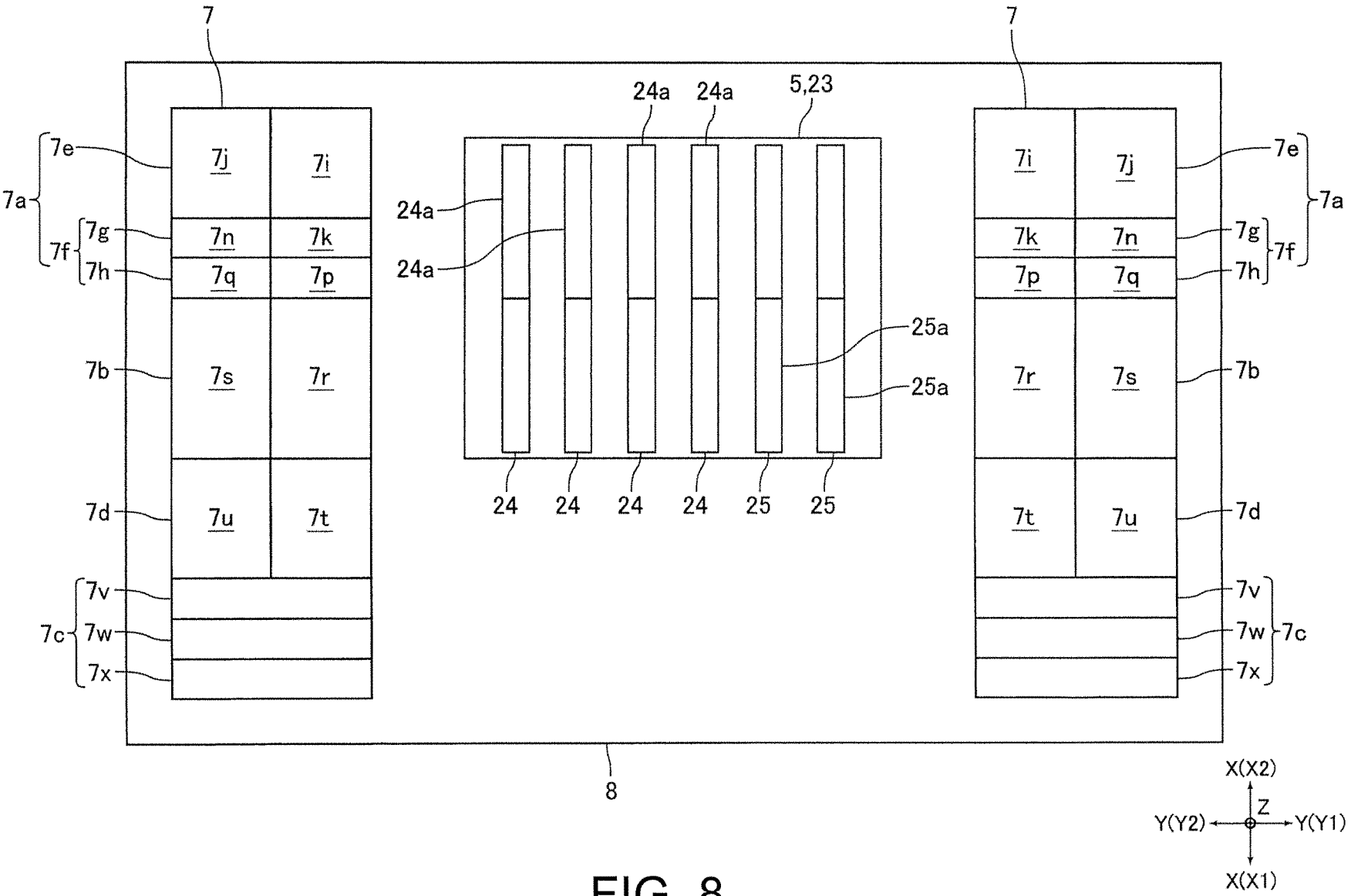
FIG. 8 is a bottom view for describing a configuration of an ink ejection portion according to another embodiment of the present disclosure.

In the embodiment described above, as shown in FIG. 8, the printer 1 may include one inkjet head 23 (head 23) instead of the heads 3 and 4. In this case, the head 23 is formed with a nozzle row 24 for ejecting color ink and a nozzle row 25 for ejecting clear ink. Furthermore, the width of the head 23 in the front-back direction is equal to the sum of the width of the head 3 in the front-back direction and the width of the head 4 in the front-back direction, the front end of the head 23 is disposed at the same position as the front end of the head 4 in the front-back direction, and the back end of the head 23 is disposed at the same position as the head 3 in the front-back direction.

In this modified example, a portion of the nozzle row 24 that is disposed behind the back end of the irradiation portion 7*b* (the portion that is disposed behind the front end of the irradiation portion 70 is a color ink ejection portion 24*a* that ejects color ink in the gloss tone printing mode. Furthermore, a portion of the nozzle row 25 that is disposed on the front side of the back end of the irradiation portion 7*b* (the portion that is disposed on the front side of the front end of the irradiation portion 7*f*) is a clear ink ejection portion 25*a* that ejects clear ink printed in the gloss tone in the gloss tone printing mode. Furthermore, in this modified example, the head 23 is an ink ejection portion 5 that ejects ultraviolet-curable ink toward the print medium 2.

In the embodiment described above, the number of ultraviolet irradiators 7 mounted on the carriage 8 may be one. Furthermore, in the embodiment described above, the ultraviolet irradiator 7 may be PWM (Pulse Width Modulation) controlled by the controller 11. Moreover, in the embodiment described above, the printer 1 may perform printing on the print medium 2 through multi-pass other than four passes. The printer 1 may perform printing on the print medium 2 with 32 passes. If the resolution of the image printed on the print medium 2 is the same, as the number of passes increases, the irradiation time of the ultraviolet rays emitted from the ultraviolet irradiator 7 to the printing region becomes longer, and thus the illuminance of the ultraviolet irradiator 7 is set low.

What is claimed is:

1. An inkjet printer that performs printing on a print medium through a multi-pass method, the inkjet printer comprising:

an ink ejection portion, configured to eject an ultraviolet-curable ink toward the print medium;

an ultraviolet irradiator, configured to cure the ultraviolet-curable ink by irradiating the ultraviolet-curable ink ejected from the ink ejection portion with ultraviolet rays;

a carriage, on which the ink ejection portion and the ultraviolet irradiator are mounted;

a carriage drive mechanism, configured to reciprocate the carriage in a main scanning direction; and a feeding mechanism, configured to relatively feed the print medium in a front-back direction orthogonal to an up-down direction and the main scanning direction with respect to the carriage;

wherein a movement of the carriage in the main scanning direction and a relative feeding of the print medium in a forward direction with respect to the carriage are alternately carried out over a plurality of times, the ink ejection portion and the ultraviolet irradiator are arranged adjacent to each other in the main scanning direction, the ink ejection portion includes: a color ink ejection portion configured to eject a color ink, and a clear ink ejection portion configured to eject a clear ink, the clear ink ejection portion is disposed on a front side of the color ink ejection portion in the front-back direction, setting a mode of printing in a gloss tone that is a gloss tone printing mode, wherein while the carriage is moved in the main scanning direction, at least the color ink is ejected to the print medium, and the color ink that is ejected is irradiated with ultraviolet rays to perform printing, and the clear ink is ejected on the color ink that is printed, the feeding mechanism relatively feeds the print medium in the forward direction with respect to the carriage by a band width that is constant at the time of printing in the gloss tone printing mode, the ultraviolet irradiator includes:

a first irradiation portion that is disposed at the same position as the color ink ejection portion in the front-back direction and irradiates the color ink ejected to the print medium with ultraviolet rays at the time of printing in the gloss tone printing mode, and a third irradiation portion that is disposed on a front side of the clear ink ejection portion in the front-back direction and irradiates the clear ink ejected and flattened on the color ink with ultraviolet rays at the time of printing in the gloss tone printing mode, the first irradiation portion is configured by a fourth irradiation portion that forms a back side portion in the front-back direction and a fifth irradiation portion that forms a front side portion in the front-back direction, width of the third irradiation portion, the fourth irradiation portion and the fifth irradiation portion in the front-back direction is greater than or equal to the band width, and an average illuminance of the fifth irradiation portion is lower than an average illuminance of the fourth irradiation portion at the time of printing in the gloss tone printing mode.

2. The inkjet printer according to claim 1, wherein the first irradiation portion is configured to emit ultraviolet rays to an extent that the color ink does not bleed by the clear ink ejected on the color ink ejected to the print medium at the time of printing in the gloss tone printing mode.

3. The inkjet printer according to claim 1, wherein the color ink ejection portion and the clear ink ejection portion are disposed close to each other in the front-back direction, and the clear ink is irradiated with leakage light from the fifth irradiation portion at the time of printing in the gloss tone printing mode.

4. The inkjet printer according to claim 2, wherein
the color ink ejection portion and the clear ink ejection portion are disposed close to each other in the front-back direction, and
the clear ink is irradiated with leakage light from the fifth irradiation portion at the time of printing in the gloss tone printing mode.

5. The inkjet printer according to claim 3, wherein
an average illuminance of the fifth irradiation portion is an illuminance that allows the clear ink to be flattened, when the clear ink is irradiated with the leakage light from the fifth irradiation portion at the time of printing in the gloss tone printing mode.

6. The inkjet printer according to claim 1, wherein
the ultraviolet irradiator includes a second irradiation portion that is disposed at the same position as the clear ink ejection portion in the front-back direction, and
an average illuminance of the second irradiation portion is an illuminance that allows the clear ink to be flattened at the time of printing in the gloss tone printing mode.

7. The inkjet printer according to claim 2, wherein
the ultraviolet irradiator includes a second irradiation portion that is disposed at the same position as the clear ink ejection portion in the front-back direction, and
an average illuminance of the second irradiation portion is an illuminance that allows the clear ink to be flattened at the time of printing in the gloss tone printing mode.

8. The inkjet printer according to claim 3, wherein
the ultraviolet irradiator includes a second irradiation portion that is disposed at the same position as the clear ink ejection portion in the front-back direction, and
an average illuminance of the second irradiation portion is an illuminance that allows the clear ink to be flattened at the time of printing in the gloss tone printing mode.

9. The inkjet printer according to claim 4, wherein
the ultraviolet irradiator includes a second irradiation portion that is disposed at the same position as the clear ink ejection portion in the front-back direction, and
an average illuminance of the second irradiation portion is an illuminance that allows the clear ink to be flattened at the time of printing in the gloss tone printing mode.

10. The inkjet printer according to claim 1, wherein
the ultraviolet irradiator includes a second irradiation portion that is disposed at the same position as the clear ink ejection portion in the front-back direction,
a back end of the second irradiation portion is in contact with a front end of the fifth irradiation portion,
a width of the second irradiation portion in the front-back direction is greater than or equal to the band width, and
at the time of printing in the gloss tone printing mode, an average illuminance of the second irradiation portion is lower than an average illuminance of the fifth irradiation portion, and an average illuminance of the third irradiation portion is higher than the average illuminance of the second irradiation portion.

11. The inkjet printer according to claim 2, wherein
the ultraviolet irradiator includes a second irradiation portion that is disposed at the same position as the clear ink ejection portion in the front-back direction,
a back end of the second irradiation portion is in contact with a front end of the fifth irradiation portion,
a width of the second irradiation portion in the front-back direction is greater than or equal to the band width, and
at the time of printing in the gloss tone printing mode, an average illuminance of the second irradiation portion is lower than an average illuminance of the fifth irradiation portion, and an average illuminance of the third irradiation portion is higher than the average illuminance of the second irradiation portion.

12. The inkjet printer according to claim 3, wherein
the ultraviolet irradiator includes a second irradiation portion that is disposed at the same position as the clear ink ejection portion in the front-back direction,
a back end of the second irradiation portion is in contact with a front end of the fifth irradiation portion,
a width of the second irradiation portion in the front-back direction is greater than or equal to the band width, and
at the time of printing in the gloss tone printing mode, an average illuminance of the second irradiation portion is lower than an average illuminance of the fifth irradiation portion, and an average illuminance of the third irradiation portion is higher than the average illuminance of the second irradiation portion.

13. The inkjet printer according to claim 4, wherein
the ultraviolet irradiator includes a second irradiation portion that is disposed at the same position as the clear ink ejection portion in the front-back direction,
a back end of the second irradiation portion is in contact with a front end of the fifth irradiation portion,
a width of the second irradiation portion in the front-back direction is greater than or equal to the band width, and
at the time of printing in the gloss tone printing mode, an average illuminance of the second irradiation portion is lower than an average illuminance of the fifth irradiation portion, and an average illuminance of the third irradiation portion is higher than the average illuminance of the second irradiation portion.

14. The inkjet printer according to claim 5, wherein
the ultraviolet irradiator includes a second irradiation portion that is disposed at the same position as the clear ink ejection portion in the front-back direction,
a back end of the second irradiation portion is in contact with a front end of the fifth irradiation portion,
a width of the second irradiation portion in the front-back direction is greater than or equal to the band width, and
at the time of printing in the gloss tone printing mode, an average illuminance of the second irradiation portion is lower than an average illuminance of the fifth irradiation portion, and an average illuminance of the third irradiation portion is higher than the average illuminance of the second irradiation portion.

15. The inkjet printer according to claim 6, wherein
the second irradiation portion is turned off at the time of printing in the gloss tone printing mode.

16. The inkjet printer according to claim 6, wherein
the ultraviolet irradiator includes a sixth irradiation portion that is disposed between the second irradiation portion and the third irradiation portion in the front-back direction,
a width of the sixth irradiation portion in the front-back direction is greater than or equal to the band width,
a back end of the sixth irradiation portion is in contact with a front end of the second irradiation portion, and
at the time of printing in the gloss tone printing mode, an average illuminance of the sixth irradiation portion is lower than an average illuminance of the third irradiation portion.

17. The inkjet printer according to claim 1, wherein
the fifth irradiation portion is configured by a seventh irradiation portion forming a back side portion of the fifth irradiation portion and an eighth irradiation portion forming a front side portion of the fifth irradiation portion, width of the seventh irradiation portion and the eighth irradiation portion in the front-back direction is greater than or equal to the band width, and at the time of printing in the gloss tone printing mode, an average illuminance of the eighth irradiation portion is lower than an average illuminance of the seventh irradiation portion.

18. The inkjet printer according to claim 1, wherein the third irradiation portion is configured by a plurality of divided irradiation portions divided in the front-back direction, width of the divided irradiation portions in the front-back direction is greater than or equal to the band width, and at the time of printing in the gloss tone printing mode, an average illuminance of each of the divided irradiation portions gradually becomes higher from a back side to the front side.

19. A control method for the inkjet printer of claim 1 comprising the step of performing printing on a print medium using the inkjet printer.

* * * * *